US009255489B2

(12) United States Patent
DiTomasso et al.

(10) Patent No.: US 9,255,489 B2
(45) Date of Patent: Feb. 9, 2016

(54) CLEARANCE CONTROL FOR GAS TURBINE ENGINE SECTION

(75) Inventors: John C. DiTomasso, Glastonbury, CT (US); Thomas J. Robertson, Glastonbury, CT (US); Gregory E. Reinhardt, South Glastonbury, CT (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 933 days.

(21) Appl. No.: 13/366,424

(22) Filed: Feb. 6, 2012

(65) Prior Publication Data

US 2013/0202418 A1 Aug. 8, 2013

(51) Int. Cl.

| | |
|---|---|
| ***F01D 25/26*** | (2006.01) |
| ***F01D 11/18*** | (2006.01) |
| ***F01D 11/12*** | (2006.01) |
| ***F01D 11/16*** | (2006.01) |

(52) U.S. Cl.

CPC ..... *F01D 11/18* (2013.01); *F01D 11/122* (2013.01); *F01D 11/16* (2013.01); *F05D 2220/36* (2013.01); *F05D 2250/184* (2013.01); *F05D 2250/283* (2013.01); *F05D 2260/30* (2013.01); *F05D 2260/38* (2013.01); *F05D 2300/173* (2013.01); *F05D 2300/501* (2013.01); *F05D 2300/603* (2013.01)

(58) Field of Classification Search

USPC ..... 415/9, 128, 170.1, 173.1, 173.3, 173.4, 415/174.2, 174.4, 196, 200, 220

See application file for complete search history.

(56) References Cited

U.S. PATENT DOCUMENTS

| | | | | |
|---|---|---|---|---|
| 4,676,715 | A * | 6/1987 | Imbault et al. | 415/116 |
| 5,192,185 | A | 3/1993 | Leonard | |
| 5,456,576 | A * | 10/1995 | Lyon | 415/173.3 |
| 5,545,007 | A * | 8/1996 | Martin | 415/173.2 |
| 6,382,905 | B1 | 5/2002 | Czachor et al. | |
| 6,547,522 | B2 | 4/2003 | Turnquist et al. | |
| 6,732,502 | B2 * | 5/2004 | Seda et al. | 60/226.1 |
| 6,935,836 | B2 | 8/2005 | Ress, Jr. et al. | |
| 7,210,899 | B2 | 5/2007 | Wilson, Jr. | |
| 7,229,246 | B2 | 6/2007 | Ghasripoor et al. | |
| 7,448,849 | B1 | 11/2008 | Webster et al. | |
| 7,771,160 | B2 | 8/2010 | Shi et al. | |
| 8,636,464 | B2 * | 1/2014 | Bottome | 415/128 |
| 2009/0260364 | A1 | 10/2009 | Keller et al. | |
| 2010/0034645 | A1 * | 2/2010 | Mulcaire et al. | 415/173.3 |
| 2011/0189009 | A1 * | 8/2011 | Shapiro et al. | 415/209.3 |
| 2011/0274538 | A1 * | 11/2011 | Shi et al. | 415/200 |
| 2011/0286839 | A1 * | 11/2011 | Wojtyczka et al. | 415/173.4 |

* cited by examiner

*Primary Examiner* — Dwayne J White
*Assistant Examiner* — Justin Seabe
(74) *Attorney, Agent, or Firm* — Carlson, Gaskey & Olds, P.C.

(57) ABSTRACT

A section of a gas turbine engine includes a case structure having a first coefficient of thermal expansion. A continuous, ring-shaped liner has a second coefficient of thermal expansion that is substantially different than the first coefficient of thermal expansion. A flexible leaf member operatively connects the liner to the case structure. The leaf member is configured to accommodate diametrical change in the liner throughout various fan section operating temperatures.

14 Claims, 3 Drawing Sheets

CLEARANCE CONTROL FOR GAS TURBINE ENGINE SECTION

BACKGROUND

This disclosure relates to a section of a gas turbine engine, for example, a fan section, and, in particular, to a conformal liner for the fan section.

One type of gas turbine engine includes a core engine having compressor and turbine sections that drive a fan section. The fan section includes circumferentially arranged fan blades disposed within a fan case. The fan section is subject to large temperature fluctuations throughout engine operation. A minimized clearance tight seal is desired between the tips of the fan blades and the fan case throughout engine operation at the various operating temperatures.

One system has been proposed to accommodate thermal expansion and contraction in a fan section having composite fan blades. The composite fan blades are arranged within a composite liner of generally the same material. Several pins at discrete circumferential locations along the liner are used to support the liner relative to a metallic fan case and permit the fan case to expand and contract relative to the composite liner.

SUMMARY

A section of a gas turbine engine includes a case structure having a first coefficient of thermal expansion. A continuous, ring-shaped liner has a second coefficient of thermal expansion that is substantially different than the first coefficient of thermal expansion. A flexible leaf member operatively connects the liner to the case structure. The leaf member is configured to accommodate diametrical change in the liner throughout various fan section operating temperatures.

In a further embodiment of the above, a blade is arranged within the case structure and includes a third coefficient of thermal expansion that is substantially similar to the second coefficient of thermal expansion. The continuous, ring-shaped liner surrounds the blade. A desired radial tip clearance is provided between the liner and the blade. The flexible leaf member maintains the desired radial tip clearance throughout various section operating temperatures.

In a further embodiment of any of the above, the case structure includes a composite case, and the blade is a metallic fan blade.

In a further embodiment of any of the above, the case structure includes a honeycomb structure operatively connected radially inward of and to the composite case.

In a further embodiment of any of the above, the case structure includes a composite septum interconnecting the adhesive and the honeycomb.

In a further embodiment of any of the above, a rub strip is supported on and radially inward of the liner between the liner and the blade.

In a further embodiment of any of the above, the blade and the liner are constructed from the same series of aluminum alloy.

In a further embodiment of any of the above, the leaf member includes first and second portions respectively affixed to the liner and the case.

In a further embodiment of any of the above, the first and second portions are provided on opposing ends of the leaf member.

In a further embodiment of any of the above, the first portion is provided on an end of the leaf member. The second portion is provided on a central part of the leaf member.

In a further embodiment of any of the above, the first portion includes a leg and a foot. The end is provided by the foot.

In a further embodiment of any of the above, the leg is angled in a circumferential direction corresponding to a blade rub direction.

In a further embodiment of any of the above, the leaf member includes overlapping straps arranged generally in an X-shaped pattern. The straps provide the first and second portions.

In a further embodiment of any of the above, the leaf member provides an annular structure with undulations about its circumference. The undulations provide peaks and valleys corresponding to the first and second portions.

In a further embodiment of any of the above, the leaf member includes discrete leafs separated from one another and oriented in a circumferential direction corresponding to a blade rub direction.

BRIEF DESCRIPTION OF THE DRAWINGS

The disclosure can be further understood by reference to the following detailed description when considered in connection with the accompanying drawings wherein.

DETAILED DESCRIPTION

Figure 1:
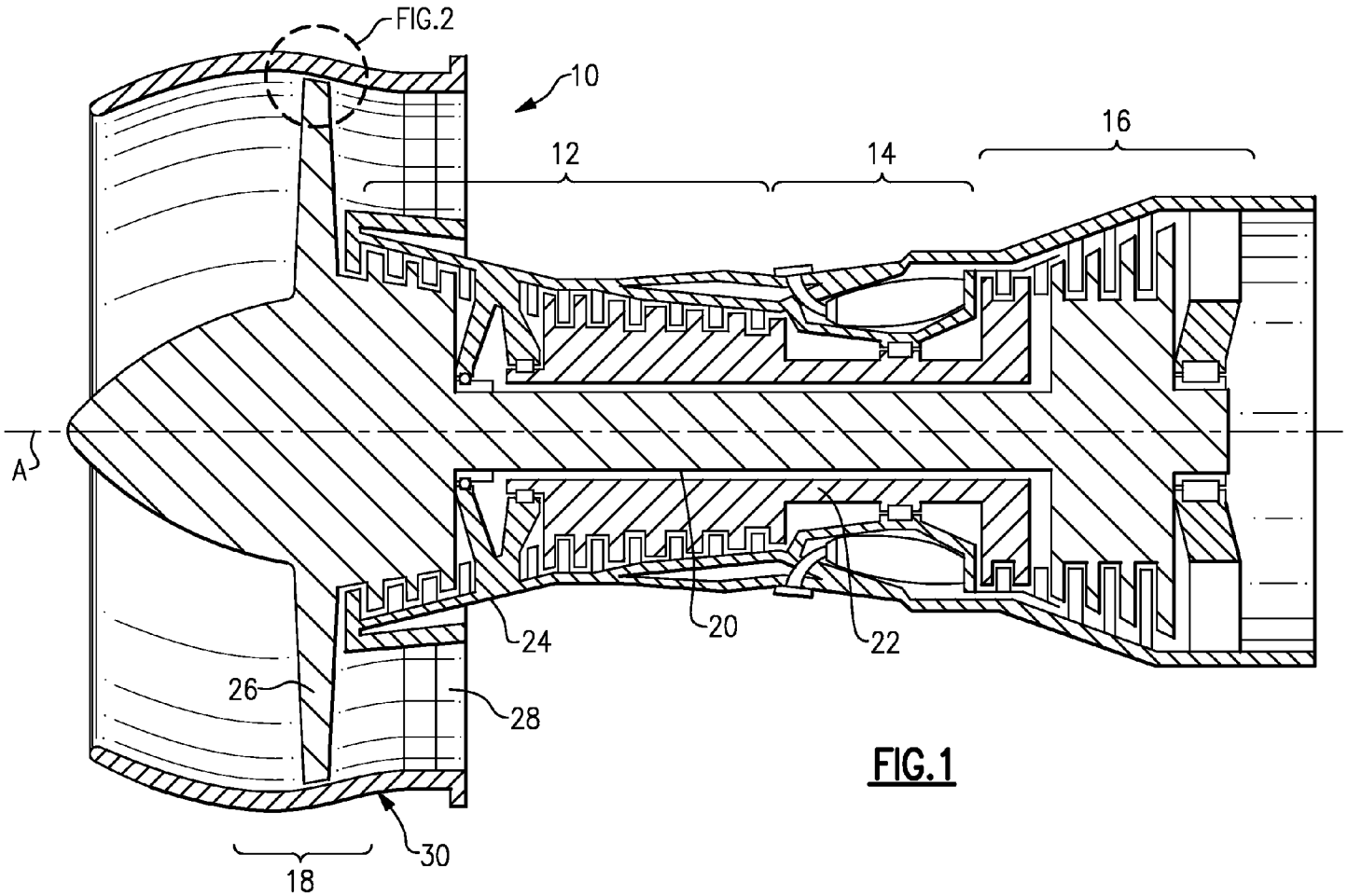
FIG. 1 is a schematic, cross-sectional side view of an example gas turbine engine.

An example gas turbine engine 10 is schematically illustrated in FIG. 1. The gas turbine engine 10 includes a compressor section 12, a combustor section 14 and a turbine section 16, which are arranged within a core housing 24. In the example illustrated, high pressure stages of the compressor section 12 and the turbine section 16 are mounted on a first shaft 20, which is rotatable about an axis A. Low pressure stages of the compressor section 12 and turbine section 16 are mounted on a second shaft 22 which is coaxial with the first shaft 20 and rotatable about the axis A. The first and second shafts 20, 22 are supported for rotation within the core housing 24.

A fan section 18 is arranged within a fan case structure 30, which provides a bypass flow path 28 between the fan case structure 30 and the core housing 24. In the example illustrated, the first shaft 20 rotationally drives circumferentially arranged fan blades 26 that provide flow through the bypass flow path 28. In one example, the fan blades 26 are constructed from an aluminum alloy. It should be understood that the configuration illustrated in FIG. 1 is exemplary only, and the disclosure may be used in other configurations. Although a high bypass engine is illustrated, it should be understood that the disclosure also relates to other types of gas turbine engines, such as turbo jets.

Figure 2:
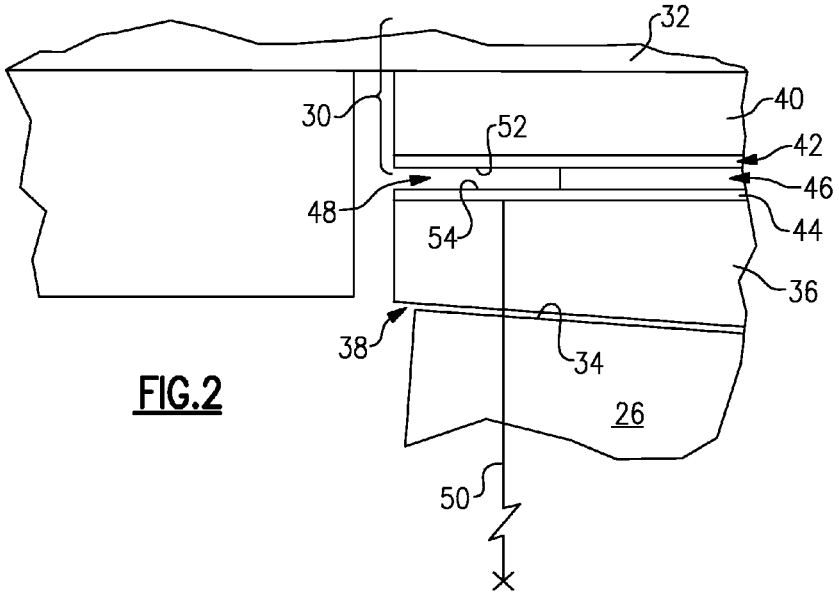
FIG. 2 is an enlarged, cross-sectional side view of a fan case structure in a fan section of the gas turbine engine shown in FIG. 1.

Referring to FIG. 2, the fan section 18 includes a fan case structure 30 comprising multiple components in one example. A honeycomb structure 40, which may be constructed from aluminum, is supported radially inward from and on the fan case 32. A septum 42 is arranged radially inward from and supported by the honeycomb structure 40. In one example, the fan case structure 30 includes a composite fan case 32, which is constructed from carbon fiber and resin in one example. In one example, the septum 42 is a composite structure constructed from fiberglass and resin. As can be appreciated, composite structures have relatively low coefficients of thermal expansion and are dimensionally stable throughout the various operating temperatures.

A continuous, ring-shaped liner 44, which is an aluminum alloy, for example, is supported by the fan case structure 30, and in the example shown, by the septum 42, using a flexible leaf member 46. The septum 42 may be constructed as part of the containment case body (fan case 32) and can be the same material. The leaf member 46 is contained within a space 48 provided between first and second surfaces 52, 54 of the septum 42 and liner 44.

The liner 44 has a coefficient of thermal expansion that is substantially the same as the coefficient of thermal expansion of the fan blades 26 and substantially different than the fan case structure 30. In one example, the fan blades 26 and liner 44 have coefficients of thermal expansion that are within $1\times10^{-6}$/° F. ($1.8\times10^{-6}$/° C.) of one another and are constructed from the same series aluminum alloy, which may be AM54027 in one example. In one example, the liner/fan blade coefficient of thermal expansion is greater than the fan case structure thermal expansion by at least $10\times10^{-6}$/° F. ($18\times10^{-6}$/° C.)

The liner 44 includes a rub strip 36 that provides an abradable material immediately adjacent to tips 34 of the fan blades 26, providing a blade tip clearance 38. It is desirable to maintain a desired radial blade tip clearance throughout various fan section operating temperatures. In one example, a desired radial tip clearance is about 0.030 in. at −65° F. (0.76 mm at −54° C.) ambient, which is typically encountered during cruise altitude. Thus, the leaf member 46 accommodates changes in a diameter 50 (only radial lead line is shown in FIG. 2) of the liner 44 as the liner 44 expands and contracts during operation.

Figure 3:
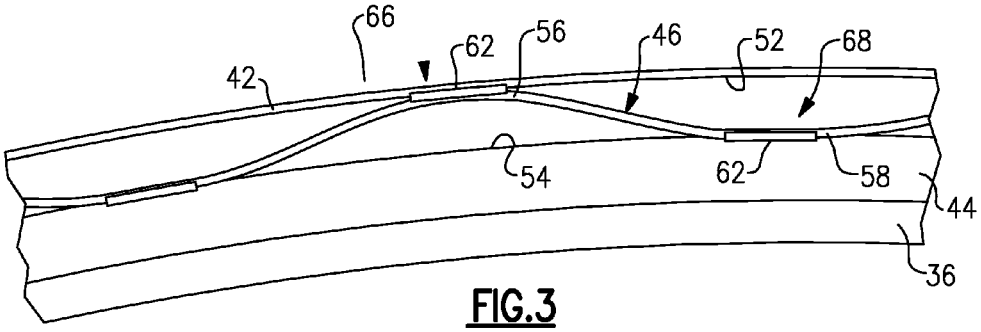
FIG. 3 is a schematic, cross-sectional end view of an example fan section depicting an example flexible leaf member.

In the examples shown in FIG. 3, the leaf member 46 is an annular sheet of material, such as metal, for example, aluminum or steel. The leaf member 46 has undulations providing peaks 56 and valleys 58 respectively secured to the septum 42 and liner 44 by fastening elements 60. In one example, the fastening elements 60 may be strips of adhesive that secure and affix first and second portions 66, 68, which correspond to the peaks 56 and valleys 58, to the first and second surfaces 52, 54.

Figure 4A:
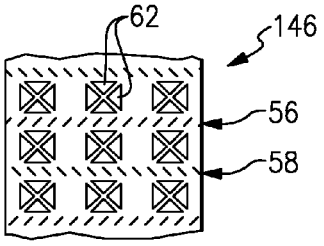
FIGS. 4A-4B respectively illustrate first and second example top views of the flexible leaf member shown in FIG. 3.
Figure 4B:
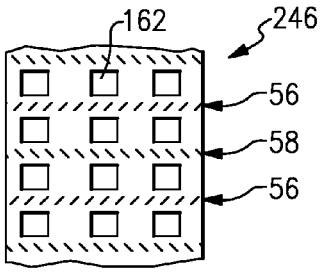

Referring to FIGS. 4A-4B, lightened leaf members 146, 246 may include perforations 62, 162 that also increase the flexibility of the leaf member. The dashed lines in the Figures indicate attachment areas at which the leaf member is secured to the septum 42 and liner 44.

Figure 5:
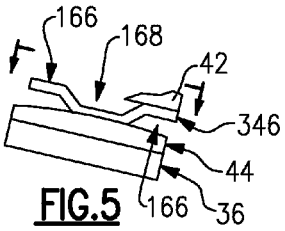
FIG. 5 is a schematic, circumferential cross-sectional view of another example fan section depicting an example flexible leaf member.
Figure 6A:
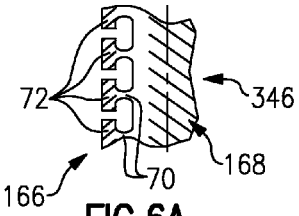
FIGS. 6A-6C respectively illustrate first, second and third example top views of the flexible leaf member shown in FIG. 5.
Figure 6B:
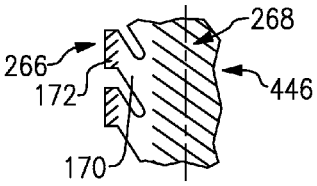

Another example leaf member 346 is shown in FIGS. 5 and 6A. The leaf member 346 includes first portions 166 arranged at opposing axial ends and a second portion 168 centrally located on the leaf member 346. The first and second portions 166, 168 are secured to the septum 42 and the liner 44, for example. To provide increased flexibility, the first portions include thin legs 70 spaced circumferentially about the perimeter of the leaf member 346. Each leg 70 terminates in a widened foot 72 that is secured to the liner 42. The legs 70 may extend axially (FIG. 6A) or may be angled in a circumferential direction that corresponds to a blade rub direction, as shown in FIG. 6B. In this manner, the legs 170, having feet 172, may absorb the circumferential load in a blade rub event.

Figure 6C:
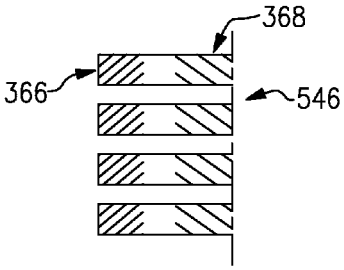

In the example shown in FIG. 6C, the leaf member 546 includes discrete, axially extending bands that provide the opposing first portions 366 and central second portion 368. The bands are circumferentially spaced about the septum 42 and liner 44 to provide a geometry similar to that illustrated in FIG. 5.

Figure 7:
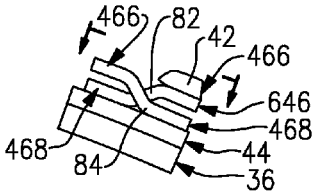
FIG. 7 is a schematic, circumferential cross-sectional view of yet another example fan section depicting an example flexible leaf member.
Figure 8A:
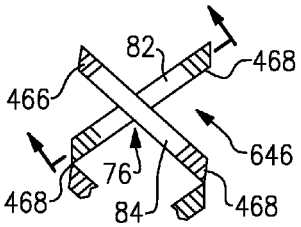
FIGS. 8A-8C illustrate first and second examples of the flexible leaf member shown in FIG. 7.
Figure 8B:
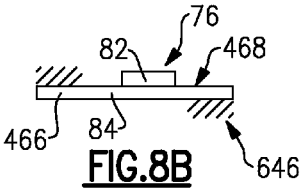
Figure 8C:
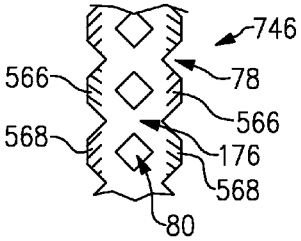

Referring to FIGS. 7-8B, the leaf member 646 includes straps 82, 84 overlapping one another at an intersection 74 to provide an X-shaped pattern. The straps 82, 84 cooperate to provide a discrete assembly, with multiple assemblies arranged circumferentially. Each strap provides both a first and second portion 466, 468 at opposing ends from one another and respectively secured to the septum 42 and liner 44 in the example shown. Another example leaf member 746 is shown in FIG. 8C. The leaf member 746 is formed from an annular member that includes notches 78 and apertures 80 that provide the X-shaped pattern having first and second portions 566, 568 similar to those described above with respect to FIGS. 7-8B.

Figure 9:
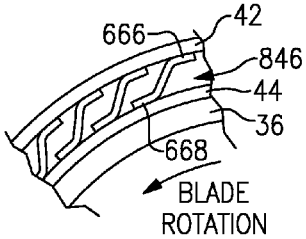
FIG. 9 is a schematic, circumferential cross-sectional view of still another example fan section depicting an example flexible leaf member.
Figure 10A:
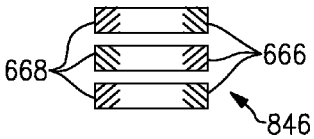
FIGS. 10A-10B respectively illustrate first and second example top views of the flexible leaf member shown in FIG. 9.
Figure 10B:
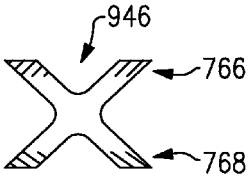

Referring to FIGS. 9-10A, an arrangement of discrete circumferentially arranged leaf members 846 is illustrated. Each leaf members 846 is oriented in a circumferential direction, as shown in FIG. 9, with the first and second portions 666, 668 secured to the septum 42 and liner 44. The circumferential direction corresponds to a blade rub direction. FIG. 10B depicts a leaf member 846 with first and second portions 746, 748 configured in an X-shape.

Although an example embodiment has been disclosed, a worker of ordinary skill in this art would recognize that certain modifications would come within the scope of the claims. For that reason, the following claims should be studied to determine their true scope and content. For example, it should be understood that the leaf member may be used in other gas turbine sections, in addition to the fan section examples disclosed.

What is claimed is:

1. A section of a gas turbine engine comprising:

a case structure having a first coefficient of thermal expansion;

a continuous ring-shaped liner having a second coefficient of thermal expansion that is substantially different than the first coefficient of thermal expansion; and a flexible leaf member having first and second portions mechanically affixed and secured respectively to the liner and to the case structure such that the first and second portions are respectively immovable with respect to the liner and to the case structure, the leaf member configured to accommodate diametrical change in the liner throughout various section operating temperatures, wherein the first and second portions are spaced from one another in a circumferential direction that corresponds to a blade rub direction.

2. The section according to claim 1, a blade arranged within the case structure and having a third coefficient of thermal expansion that is substantially similar to the second coefficient of thermal expansion, the continuous ring-shaped liner surrounding the blade, a desired radial tip clearance between the liner and the blade, and the flexible leaf member maintaining the desired radial tip clearance throughout various section operating temperatures.

3. The section according to claim 2, wherein the case structure includes a composite case, and the blade is a metallic fan blade.

4. The section according to claim 3, wherein the case structure includes a honeycomb structure operatively connected radially inward of and to the composite case.

5. The section according to claim 4, wherein the case structure includes a composite septum interconnected to the honeycomb by an adhesive.

6. The section according to claim 5, comprising a rub strip supported on and radially inward of the liner between the liner and the blade.

7. The section according to claim 3, wherein the blade and the liner are constructed from the same series aluminum alloy.

8. The section according to claim 1, wherein the first and second portions are provided on opposing ends of the leaf member.

9. The section according to claim 1, wherein the first portion is provided on an end of the leaf member, and the second portion is provided on a central part of the leaf member.

10. The section according to claim 9, wherein the first portion includes a leg and a foot, the end provided by the foot.

11. The section according to claim 10, wherein the leg is angled in the circumferential direction.

12. The section according to claim 1, wherein the leaf member includes overlapping straps arranged generally in an X-shaped pattern, the straps providing the first and second portions.

13. The section according to claim 1, wherein leaf member is provided an annular structure with undulations about its circumference, the undulations provided peaks and valleys corresponding to the first and second portions.

14. The section according to claim 1, wherein the leaf member includes discrete leafs separated from one another and oriented in the circumferential direction.

* * * * *